United States Patent [19]

Hagg et al.

[11] 4,262,433

[45] Apr. 21, 1981

[54] SOLE BODY FOR FOOTWEAR

[76] Inventors: Vernon A. Hagg, 5245 Heritage Hills Dr., Bloomington, Minn. 55437; Phillip W. Trask, 18300-32nd Ave. N., Wayzata, Minn. 55391

[21] Appl. No.: 932,032

[22] Filed: Aug. 8, 1978

[51] Int. Cl.[3] ..... A43B 13/00; A43B 13/18; A43B 21/28

[52] U.S. Cl. ..... 36/25 R; 36/32 R; 36/35 B

[58] Field of Search ..... 36/32, 25 R, 27, 28, 36/29, 30 R, 3 R, 35 R, 35 B, 32 R, 3 B

[56] References Cited

U.S. PATENT DOCUMENTS

| | | | |
|---|---|---|---|
| 74,912 | 2/1868 | Hadley | 36/3 B |
| 644,412 | 2/1900 | Dunbar | 36/3 R |
| 1,029,110 | 6/1912 | Drobinski | 36/3 R |
| 2,412,623 | 12/1946 | Maling | 36/30 R |
| 2,885,797 | 5/1959 | Chrencik | 36/28 X |
| 3,231,454 | 1/1966 | Williams | 36/3 R |
| 3,251,145 | 5/1966 | Mack | 36/28 X |
| 3,280,484 | 10/1966 | Sensi | 36/30 R |
| 3,936,956 | 2/1976 | Famolare, Jr. | 36/32 R |
| 4,020,569 | 5/1977 | Fukuoka | 36/29 |
| 4,041,618 | 8/1977 | Famolare, Jr. | 36/25 R |

FOREIGN PATENT DOCUMENTS

| | | | |
|---|---|---|---|
| 15421 | of 1899 | United Kingdom | 36/35 B |
| 1490219 | 10/1977 | United Kingdom | 36/32 R |

*Primary Examiner*—James Kee Chi

*Attorney, Agent, or Firm*—Wicks & Nemer

[57] ABSTRACT

A sole body for footwear including a longitudinally extending body having an upturned fore part extending rearwardly from the front end of the sole body which terminates in a front groove extending transversely of and in the bottom thereof. A central rocker portion is formed on the bottom of the sole body substantially midway between the front end and the rear end of the sole body and connecting with said front groove with a heel formed on the rear part of the sole body. The heel includes a compressible insert intermediate the upper and lower surfaces of the heel portion. The rocker portion is arcuate convexly outwardly of the sole body on an axis perpendicular to the longitudinal axis of the sole body and extending outwardly beyond a plane connecting the outermost surface of said fore part portion and said heel whereby a roll action of the sole body is provided between the initial contact of the compressible heel and the fore part in the gait of the user.

10 Claims, 16 Drawing Figures

SOLE BODY FOR FOOTWEAR

SUMMARY

The invention relates generally to footwear and more particularly to a sole body for footwear. It is an object of the invention to provide a sole body including a heel portion having a compressible insert and contiguous to and forwardly of the heel is a rocker portion extending transversely of the sole body and which is convex with respect to a vertical axis. Forwardly of and contiguous to the rocker portion is the upwardly curved forepart and intermediate the rocker portion and the forepart is a front flexure groove which extends arcuately and transversely of the sole body. The groove is flexure shaped in cross section and the flexure groove is directed generally upwardly and towards the foremost part of the forepart of the sole body. A rear groove is formed intermediate the heel and the rocker portion and the groove extends arcuately and transversely across the bottom of the sole body and generally inwardly and upwardly into the heel.

The sequence of action with the sole body in the gait of the user is the initial impact on the heel with the compressible heel compressing resulting in expansion with a spring like movement onto the rocker portion, the rocker portion impelling the foot forwardly onto the forepart with the front flexure groove creating a flexibility in the sole for ease in the finishing movement of the user's gait.

The unique benefits of the sequent of action are the reduction of shock as a result of the compressible heel insert, the spring like action from the heel onto the rocker portion, the rocker portion increasing ease of movement due to a roll-on effect from the rocker portion to the forepart which reduces pressure on the metatarsal arch and heads compared to a conventional sole function with which there is more pronounced impact. The front flexure groove increases flexibility of the sole body relieving further pressure on the metatarsal arch and heads and enhancing toe function in the user's gait. The entire action of the sole body increases the health and efficiency of the foot in its functions of mobility.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 2:
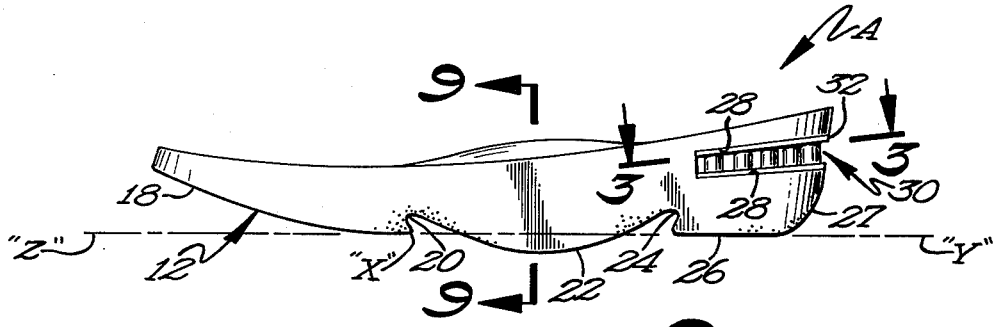
FIG. 2 is a side elevational view thereof.
Figure 2A:
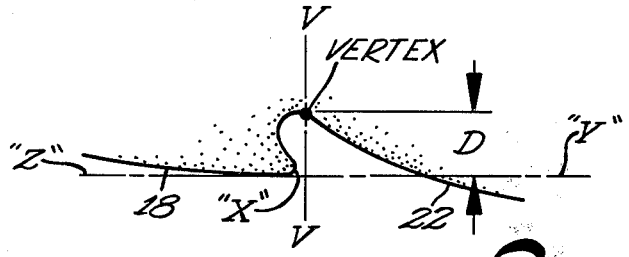

FIG. 2*a* is a diagram of the vertex of the flexure of the front groove in the sole body.

Figure 3:
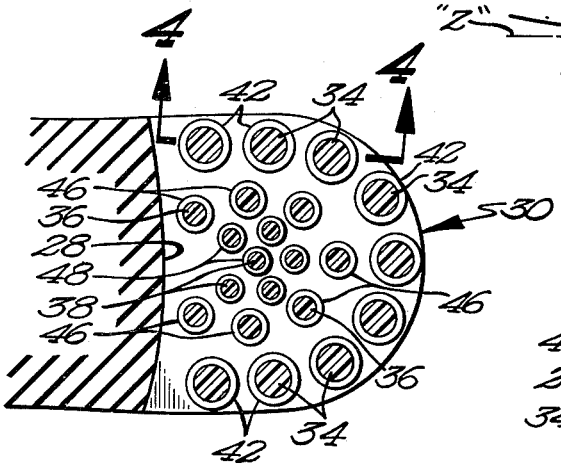

FIG. 3 is a sectional view on the line 3—3 of FIG. 2.

Figure 4:
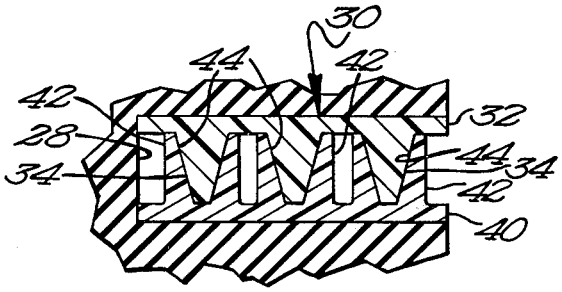
Figure 11:
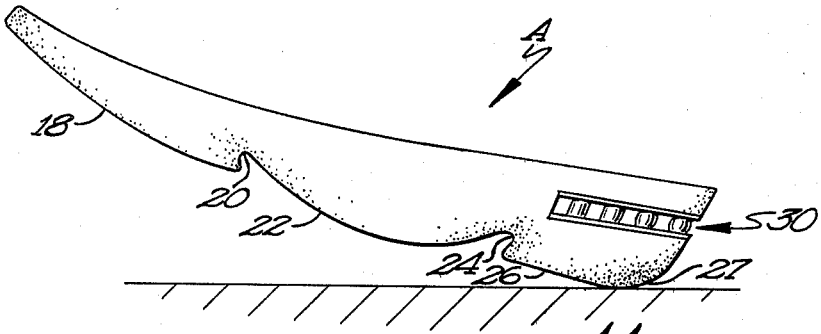
Figure 12:
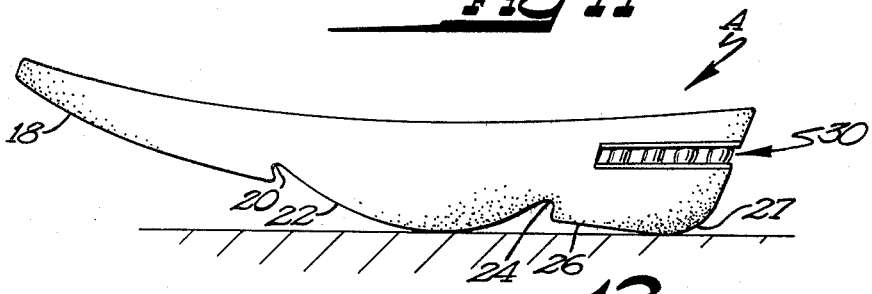

FIG. 4 is a sectional view on the line 4—4 of FIG. 3.

Figure 5:
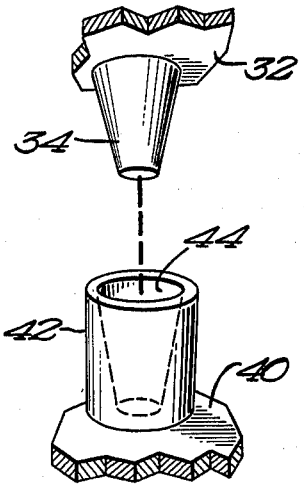

FIG. 5 is a perspective view of the interfitting half portions of the insert for the heel portion of the sole.

Figure 6:
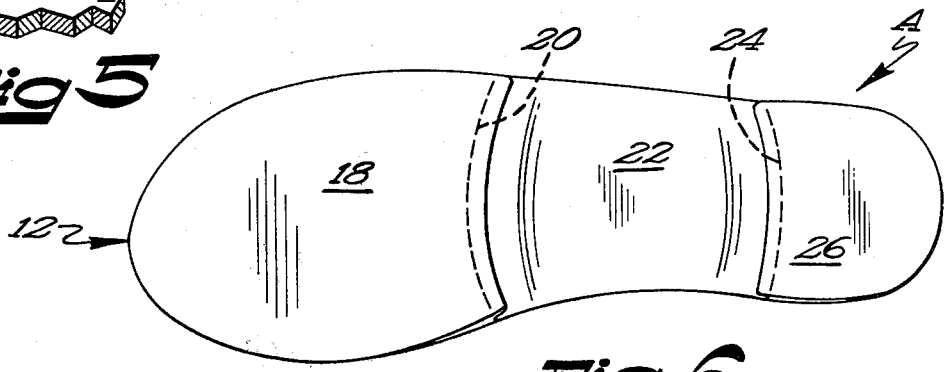

FIG. 6 is a bottom plan view of the sole.

Figure 7:
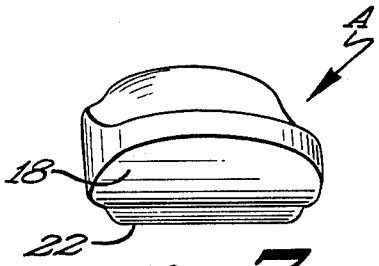

FIG. 7 is a front view of the sole.

Figure 8:
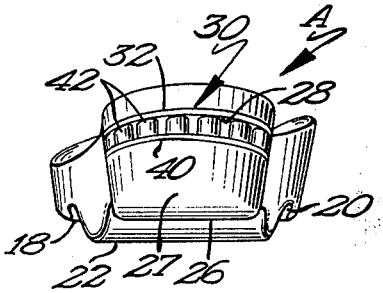

FIG. 8 is a rear view of the sole.

Figure 9:
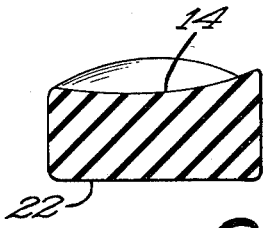

FIG. 9 is a sectional view on the line 9—9 of FIG. 2.

Figure 1:
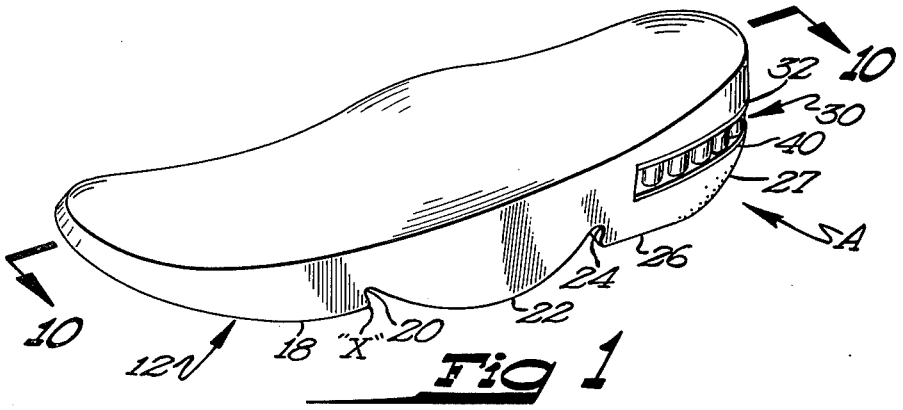
FIG. 1 is a perspective view of a sole for a shoe embodying the invention.
Figure 10:
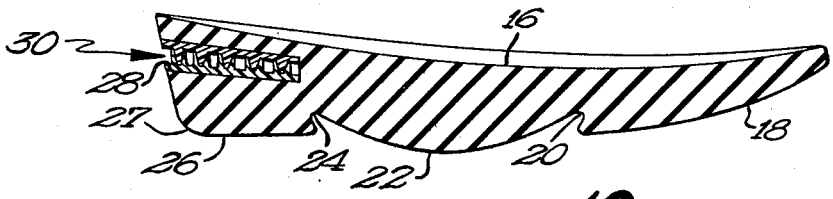

FIG. 10 is a sectional view on the line 10—10 of FIG. 1.

FIGS. 11–15 illustrate the progressive action of contact of the sole body from the initial contact of the heel to the contact of the fore part during the gait of a user.

Referring to the drawings in detail, the sole A includes the sole body 12 which may be molded in one piece of a thermoplastic, polyurethane, PVC, plantation crepe rubber, or the like, together with combination of wood and/or leather, if desired. The interior of the sole body can be either solid or of a honeycomb construction. The thickness of the sole body can be varied depending upon the intended use of the footwear embodying the sole body. With the sole body of the above referred to materials there is some flexibility and resiliency in the sole body. The uppermost surface of the sole body 12 is concave transversely substantially throughout the width of the sole as at 14 with the inner side at the instep area raised to be subvene for the inner longitudinal arch. The centerline of the top surface of the sole body is slightly arcuate from toe to heel as at 16 and combined with the transverse concave formation at the heel forms a cup-like formation at the heel.

The bottom surface of the sole has the fore part 18 which curves upwardly from point "X" to the foremost part of the forepart 18. The forepart 18 terminates rearwardly at point "X" at which point there is the transverse front groove 20 which is flexure shaped in cross section and which extends arcuately across the bottom of the sole, and the groove extends forwardly and inwardly into the forepart 18. The term "flexure" is defined under the definition of the word "curve" on p. 649 as "a bending without angles," Webster's New International Dictionary 2nd Edition. The groove 20 is flexure shaped in cross section, with the flexure groove directed generally upwardly and towards the foremost part of the forepart of the sole body. The groove 20 provides a flexible area in the sole body directly rearwardly of the metatarsal arch and therefore flexibility between the forepart 18 and the forward edge of the central rocker portion 22 and the disposition of the flexure shaped groove described above aids in such flexibility. The penetrating depth of the groove 20 is contingent on the desired flexibility relative to the thickness and material of the sole body. However, the depth of the groove 20 is about 30% of the thickness of the sole body at the groove, that is to say that depth of the groove at the vertex thereof as in FIG. 2*a* and indicated as D is about 30% of the thickness of the sole body at the groove on the line V—V, FIG. 2*a*.

Extending rearwardly from the rearwardmost surface of the groove 20 is the convex rocker portion 22 which extends transversely across the sole body and contiguous to the arcuate groove 20. The rocker portion 22 terminates in the rear groove 24. The groove 24 extends arcuately and transversely across the bottom of the sole body and generally inwardly and upwardly into the heel portion 26. The heel is curved as at 27. The grooves 20 and 24 allow the rocker formation 22 between the same to be of a greater circumferential length relative to the line "Y - Z" and therefore provides a more pronounced rocker action as hereinafter referred to. The numeral 28 designates a slot which extends into and across the heel from the extreme rear portion. The slot 28 receives the compressible insert 30.

The rocker portion 22 extends below the line "Y - Z" extended between the bottom of the forepart 18 and the bottom of the heel portion 26, particularly FIG. 2, with the benefits hereinafter referred to.

With reference to the rocker portion 22 the same materially aids in distributing weight for less pressure on the tarsus and metatarsal arch by supporting the longitudinal arches in mobility and also in standing by the user.

The compressible insert 30 includes an upper flat base portion 32 from which depends the truncated conical spaced outer male formations 34 which are larger at the base in diameter than intermediate inner spaced truncated conical formations 36. Spaced inwardly from the intermediate formations 36 are the innermost spaced truncated conical formations 38 which are smaller at the base than the intermediate truncated conical formations.

The outermost formations 34 are spaced at the edges of the heel, the formations 36 are spaced inwardly of formations 34 and substantially in a circular formation, and the innermost truncated conical formations 38 are spaced in somewhat circular formation, with a central truncated conical formation.

The compressible insert 30 further includes a lower flat base portion 40 and extending upwardly from the base are the spaced outer cylindrical column formations 42. Each cylindrical column formation 42 is formed with a hollow female truncated cone formation 44 into which is positioned the truncated male formations 34. Spaced inwardly from the cylindrical column formations 42 are the intermediate cylindrical column formations 46 each of which is formed with a hollow female truncated cone formation and each of which receives a male truncated conical formation 36. Further provided are the innermost cylindrical column formations 48 with hollow female truncated cone formations similar to formations 44 each of which receives a male truncated cone formation, similar to formations 34.

The various truncated conical male formations are cemented and positioned in the mating hollow truncated conical female formations, particularly FIG. 4 to form the cylindrical columns. The insert 30 is then cemented and positioned into the slot 28. The various cylindrical columns 42, 46 and 48 are made of a compressible material such as elastomer material or the like.

With particular reference to FIGS. 11–15, in walking with the sole A, contact and pressure is first made on the heel and then progressively upon the heel and rocker portion 22, thence to the rocker portion alone, thence to the rocker portion and the arcuate forepart 18 and lastly the forepart 18, particularly FIGS. 11–15. The rocker portion 22 creates additional ease in forward movement by impelling the foot forward in the gait from the position of FIG. 12 to that of FIG. 14. Such additional ease in forward movement helps to lessen sliding of the foot in the footwear and lessens foot elongation, thereby reducing strain of the ligaments and irritating friction which may lead to enlargement of the bursa sacs in the joints of the foot.

Figure 13:
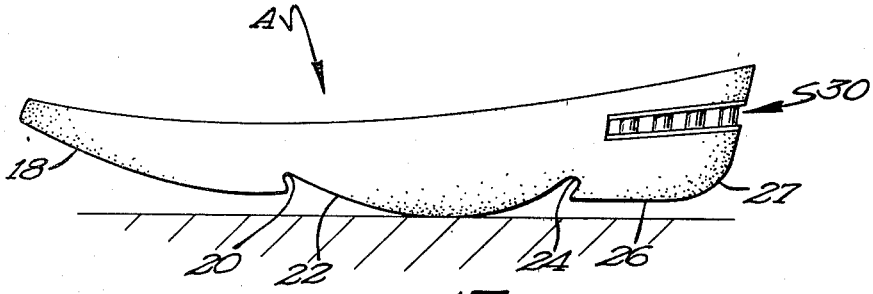
Figure 14:
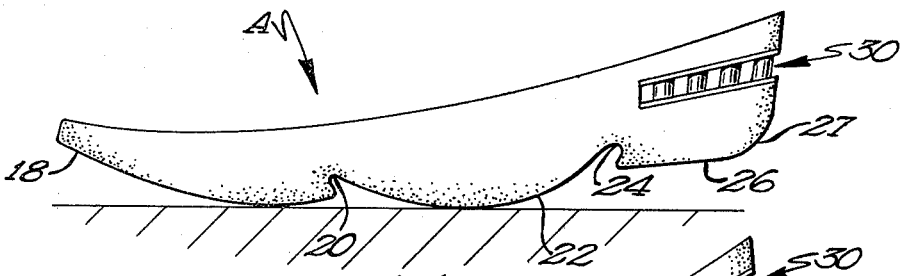
Figure 15:
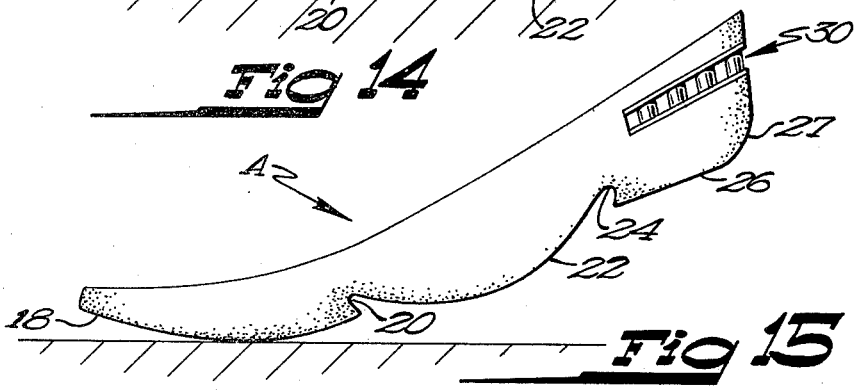

A further benefit is derived from the rocker portion which reduces pressure and shock on the metatarsal arch and metatarsal heads by a roll-on from FIG. 13 to that of FIG. 14 rather than a more pronounced impact as found in conventional soles. With the roll-on effect caused by the rocker portion 22, the use of the toes is enhanced for grip-grasp action of the same. Such increased toe action improves balance in the gait because of less pressure exerted on the metatarsal arch, and as a result, the toes are exercised which improves circulation in the feet and legs thereby reducing fatigue. Additionally, the rocker portion 22, with the influence of the heel insert, aids in centering the gait not only for less strain on the foot and improved function of its anatomy, but also more even wear on the bottom of the sole which results in extended proper treading of the sole.

The front arcuate groove 20 which is just behind the location of the ball of the foot on the sole A creates increased flexibility of the sole at the groove due to the disposition of the groove and the fact that it reduces the thickness of the sole substantially. Such flexibility relieves pressure on the metatarsal arch and metatarsal heads across the ball of the foot. With the reduction in pressure, the toe movements are enhanced which leads to improved function of the toes for a grip-grasp action and balance. The toes are exercised for improved circulation of the feet and legs thereby reducing fatigue of feet and legs.

The groove 20 also creates more effective and continued action of the rocker in impelling the foot forwardly due to the pronounced and increased flexibility of the sole at and by means of the groove 20. Also, the transversely arcuate nature of the groove 20 in combination with the curvature of the rocker conforms to the curve of the metatarsal heads of the foot from the first to the fifth which aids in distributing weight and pressure properly, and the front groove aids in lessening the strain on the plantar fascia of the foot.

The upturned bottom surface of the forepart 18 aids in movement to spring off on the next step. The forepart 18 aids in a more effective and continued action of the rocker 22, and front groove 20, due to the curve conforming to the upward curve of the toes in the finishing movement of the gait.

The compressible heel insert 30 absorbs shock of the initial contact of the sole body with a firm surface and which lessens jar and pressure on the tarsus and particularly the heel bone (oscalcis) together with a lessening of strain on the ligaments between the joints of the tarsus. With the ability of the heel to depress in the compressible heel insert, there is less strain placed on the longitudinal arches and particularly the inner one. In standing, the compressible heel reduces strain on the feet, legs and back due to the reduction of rigidity. Also, due to the compression of the heel insert, the centering of the gait is aided for less uneven wear on the bottom of the heel, thereby sustaining the proper treading of the sole for a longer period of time. The ability of the heel to depress aids in keeping the foot from sliding forwardly in the footwear upon initial impact of the heel in the gait. The decompression of the heel insert gives a spring or expansion after depression which facilitates the initial movement in the gait onto the rocker 22 thereby continuing and improving the effectiveness of expansion. The columns, in the insert 30, as will be seen, are smaller in diameter towards the center of the insert, and the smallest and innermost columns with the greatest elasticity are at a point in line with the heel bone. With the outermost columns of the heel insert being large greater stability for the heel is provided.

It will also be seen that with the columns in the compressible insert 30 a more dynamic cushioning with a compression and reflexive expansion action effect hitherto not attainable with a more or less solid piece of cushioning material. With a more or less solid piece of cushioning material all weight bearing points are equally distributed over the entire area used. Each point in a solid cushion is supported by the point next to it and therefore each point in a solid cushion insert will compress less to support its share of the weight load. With the columns of the application formed of the same material as that of a solid insert, each column must absorb more of the weight bearing load which allows more complete compression and resultant greater expansion. Conversely, the reflexive (expansion) movement upwardly in a solid cushioning material after compression is retarded by its lack of ability to compress originally. Retardation of this expansion movement in a solid cushioning material inhibits a spring from the heel portion of the sole unit. A multiplicity of columns as in the present disclosure compresses more completely and has, in effect, more resiliency and offers more spring or dynamic expandability. The columns of the insert in the heel allow the heel of the wearer to travel through a greater distance in absorbing shock than has hitherto been possible. Further, the columns of the heel insert may vary in height, diameter, spacing, configuration and material depending upon intended use of the footwear.

With reference to FIGS. 11–15, there is illustrated the progressive action or "roll-on" of the sole body through the gait of a user beginning with the initial contact of the heel at the rounded portion 27 upon surfaces at which point there is compression in the heel insert. Next there is contact of both heel and rocker portion with some decompression of the heel insert as in FIG. 12. Next the contact is only on the rocker portion with full decompression of the heel insert followed by contact of the rocker portion and the forepart 18 which is followed by contact solely on the forepart.

Having thus described the invention, what is claimed as new and desired to be secured by Letters Patent is:

1. A sole body for footwear comprising:

(a) a longitudinally extending body, (b) the bottom of said body having an upturned fore part portion extending rearwardly from the front end of the sole body and terminating in, (c) a single front groove at the rearmost edge of said fore part portion and extending transversely of and in the bottom thereof.

(d) a rocker portion formed on the bottom of said sole body substantially midway between the front end and the rear end of the sole body and connecting with said front groove and, (e) a heel formed on the rear part of said sole body, (f) said rocker portion being arcuate convexly outwardly of said sole body on an axis perpendicular to the longitudinal axis of the sole body and extending outwardly beyond a plane connecting the outermost surface of said fore part portion in alignment with the area of the sole in which the ball area of the foot contacts the sole and said heel, whereby a roll action of the sole body is provided on the rocker portion between the contact of the heel and the ball area of the fore part in the gait of a user.

2. The device of claim 1 in which said front groove extends arcuately across the bottom of the sole body at a point adjacent the metatarsal heads of a foot positioned on the sole body.

3. The device of claim 2 in which said heel has a compressible portion within the same and intermediate the upper and lower surfaces of said heel.

4. The device of claim 1 in which said heel has a compressible portion within the same and intermediate the upper and lower surfaces of said heel.

5. The device of claim 1 in which said groove is flexure shaped in cross section.

6. The device of claim 5 in which the depth of the flexure shaped groove at the vertex is about thirty percent of the thickness of the sole body at the groove with the groove directed upwardly and forwardly toward the forepart of the sole body.

7. The device of claim 3 in which said compressible portion of said heel includes a multiplicity of spaced columns of compressible material throughout the extent of the heel portion.

8. The device of claim 7 in which the diameter of said columns adjacent the outer portion of the compressible portion is greater than those columns inwardly of the outer portion.

9. A sole body for footwear comprising:

(a) a longitudinally extending sole body having a fore portion and (b) a heel portion, (c) said heel portion having a compressible portion of compressible material intermediate the upper and lower surfaces of said heel portion, (d) said compressible portion of said heel including a multiplicity of spaced compressible columns throughout the extent of the compressible portion.

10. A sole body for footwear comprising:

(a) a longitudinally extending sole body having a fore portion and (b) a heel portion, (c) said heel portion having a compressible portion of compressible material intermediate the upper and lower surfaces of said heel portion, (d) said compressible portion of said heel including a multiplicity of spaced columns throughout the extent of the compressible portion, (e) the diameter of said columns adjacent the outer portion of the compressible portion being greater than those columns inwardly of the outer portion.

* * * * *